US011428176B2

(12) United States Patent
Moine

(10) Patent No.: US 11,428,176 B2
(45) Date of Patent: Aug. 30, 2022

(54) METHOD AND SYSTEM FOR CONTROLLING A VEHICLE ENGINE SPEED

(71) Applicant: VITESCO TECHNOLOGIES GMBH, Hanover (DE)

(72) Inventor: Xavier Moine, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/287,243

(22) PCT Filed: Oct. 22, 2019

(86) PCT No.: PCT/EP2019/078745
§ 371 (c)(1),
(2) Date: Apr. 21, 2021

(87) PCT Pub. No.: WO2020/083922
PCT Pub. Date: Apr. 30, 2020

(65) Prior Publication Data

US 2021/0381450 A1 Dec. 9, 2021

(30) Foreign Application Priority Data

Oct. 22, 2018 (FR) ..... 1859716

(51) Int. Cl.
*F02D 41/00* (2006.01)
*F02D 41/14* (2006.01)
*F02D 31/00* (2006.01)

(52) U.S. Cl.
CPC ..... *F02D 41/0002* (2013.01); *F02D 31/002* (2013.01); *F02D 41/1406* (2013.01);
(Continued)

(58) Field of Classification Search
CPC ..... F02D 41/00; F02D 41/0002; F02D 41/14; F02D 41/1406; F02D 41/1497;
(Continued)

(56) References Cited

U.S. PATENT DOCUMENTS 5,771,483 A 6/1998 Moine et al.
7,554,213 B2 6/2009 Kawakami et al.
(Continued)

FOREIGN PATENT DOCUMENTS

EP 2 228 527 9/2010
EP 2 461 005 6/2012
(Continued)

OTHER PUBLICATIONS

International Search Report for PCT/EP2019/078745 dated Dec. 16, 2019, 6 pages.
(Continued)

*Primary Examiner* — John Kwon
*Assistant Examiner* — Johnny H Hoang
(74) *Attorney, Agent, or Firm* — Nixon & Vanderhye

(57) ABSTRACT

Disclosed is a method for controlling a speed of a vehicle combustion engine, the engine including at least one combustion chamber, into which a mixture of air and fuel is injected, and an air box, configured to inject the air into the combustion chamber and having an air flow rate controlled by a regulating butterfly valve, the regulating butterfly valve having a variable angular position, controlled by a predetermined position of an actuator. The method includes the steps of evaluating a so-called "load" resistant torque resulting from a plurality of external loads applied to the engine, determining, from the calculated load resistant torque, a position of the actuator, so as to determine an angular position of the regulating butterfly valve, and controlling the position of the actuator, so as to control the engine speed.

18 Claims, 3 Drawing Sheets

(52) U.S. Cl.
CPC .. *F02D 41/1497* (2013.01); *F02D 2200/1004* (2013.01); *F02D 2200/1006* (2013.01); *F02D 2250/18* (2013.01)

(58) Field of Classification Search
CPC ..... F02D 31/002; F02D 2200/1004; F02D 2200/1006; F02D 2250/18; G06F 7/00
See application file for complete search history.

(56) References Cited

U.S. PATENT DOCUMENTS

| | | | | |
|---|---|---|---|---|
| 9,037,385 | B2 | 5/2015 | Maki et al. | |
| 9,909,511 | B2 | 3/2018 | Koenen et al. | |
| 2004/0044461 | A1 | 3/2004 | Ueda | |
| 2005/0154524 | A1 | 7/2005 | Matsuda et al. | |
| 2008/0191658 | A1* | 8/2008 | Bruno | E06B 9/68 318/779 |
| 2012/0179341 | A1* | 7/2012 | Hou | B60W 30/143 701/54 |
| 2012/0181967 | A1* | 7/2012 | Fulton | H02K 29/08 318/480 |
| 2019/0178185 | A1* | 6/2019 | Barbolini | F02D 35/021 |
| 2020/0204095 | A1* | 6/2020 | Hu | H02P 7/29 |

FOREIGN PATENT DOCUMENTS

| | | |
|---|---|---|
| EP | 3 137 757 | 3/2017 |
| FR | 2 735 232 | 12/1996 |
| JP | 2007-318867 | 12/2007 |

OTHER PUBLICATIONS

Written Opinion of the ISA for PCT/EP2019/078745 dated Dec. 16, 2019, 6 pages.

* cited by examiner

[Fig. 1]
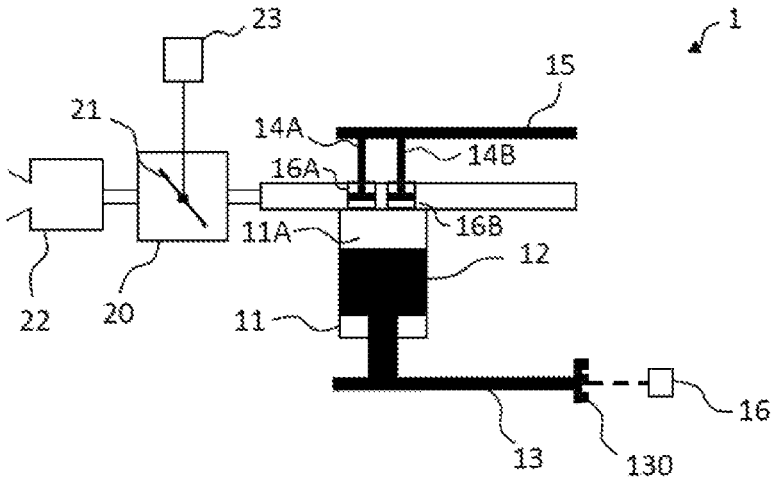
[Fig. 2]
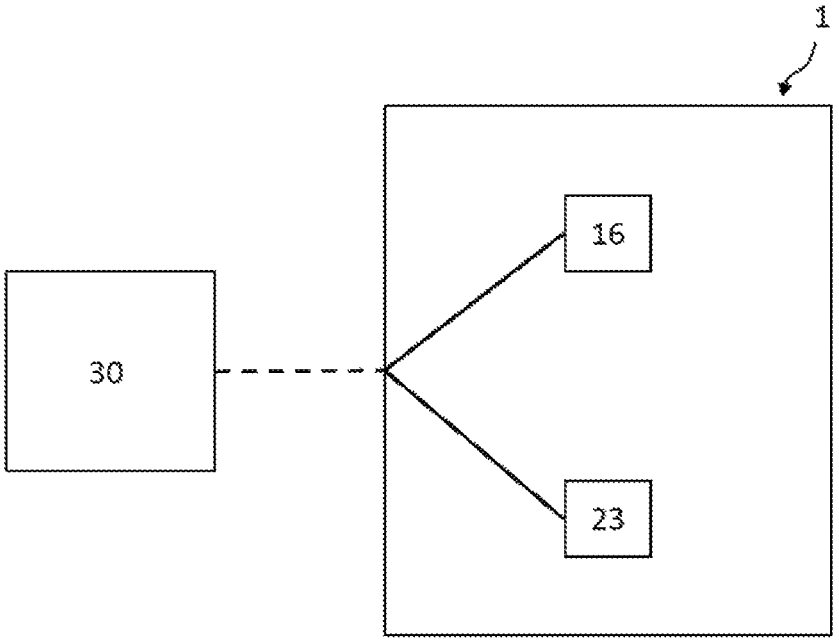

[Fig. 3]
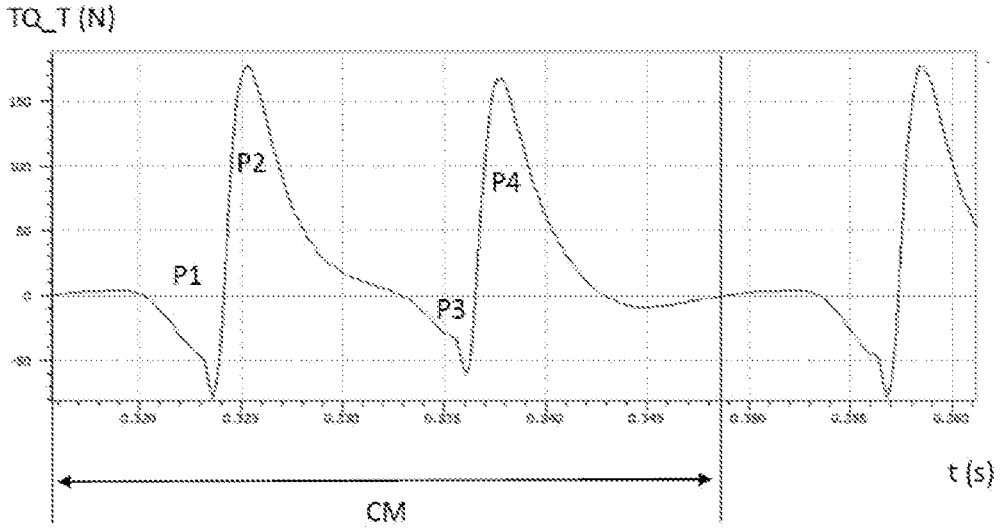
[Fig. 4]
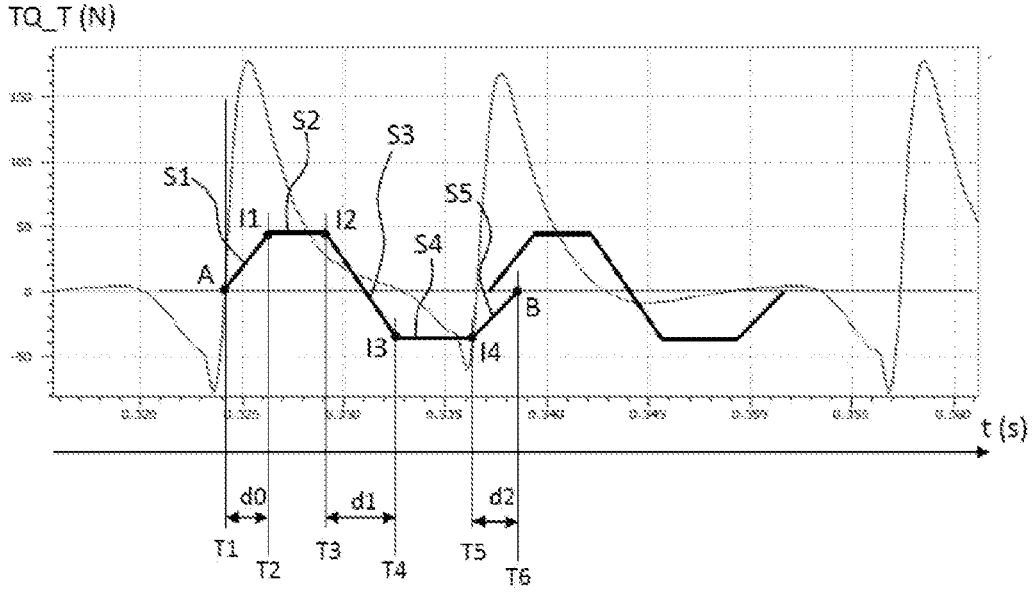

[Fig. 5]
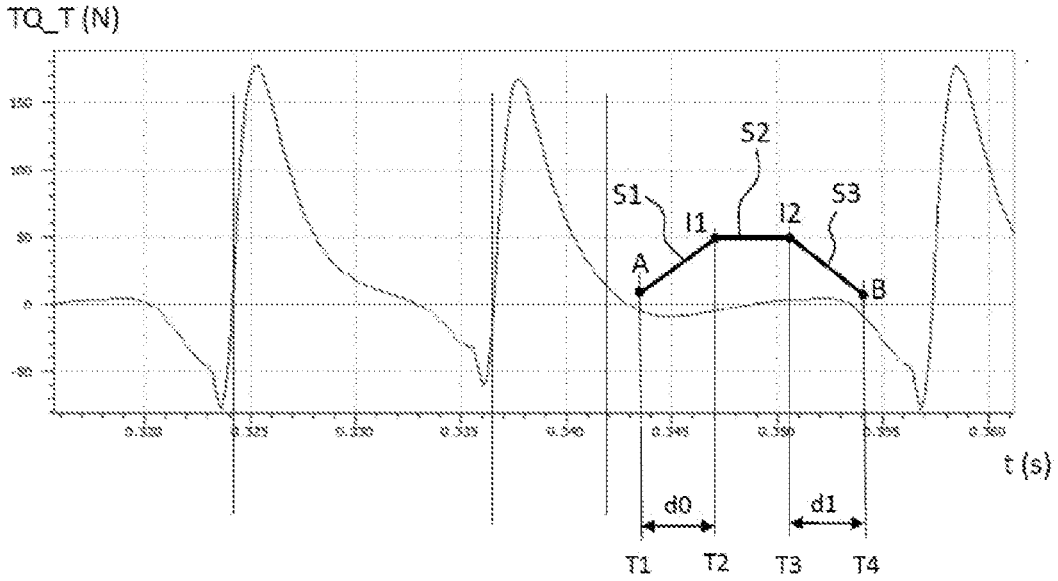
[Fig. 6]
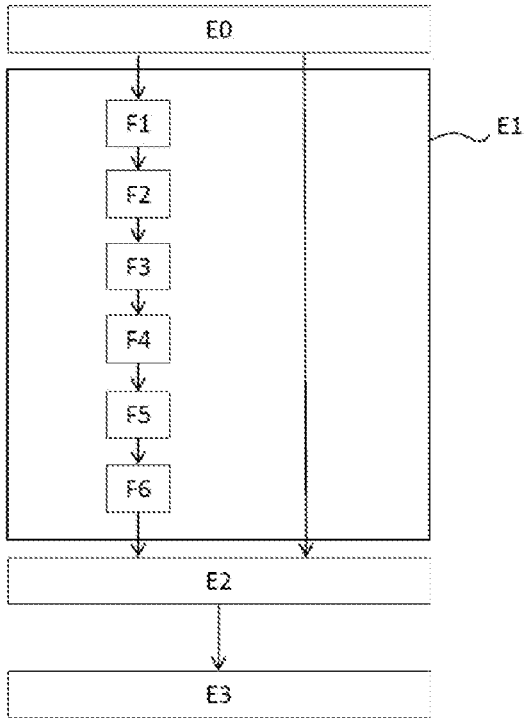

METHOD AND SYSTEM FOR CONTROLLING A VEHICLE ENGINE SPEED

CROSS-REFERENCE TO RELATED APPLICATIONS

This application is the U.S. national phase of International Application No. PCT/EP2019/078745 filed Oct. 22, 2019 which designated the U.S. and claims priority to FR 1859716 filed Oct. 22, 2018, the entire contents of each of which are hereby incorporated by reference.

BACKGROUND OF THE INVENTION

Field of the Invention

The invention relates to the field of combustion engines, and more particularly concerns a method for controlling the speed of a vehicle combustion engine operating at constant speed. The invention is aimed in particular at limiting the unwanted changes in engine speed in order to limit the risks of damage to the engine or to any equipment that might be electrically powered by said vehicle.

Description of the Related Art

In a known way, a vehicle combustion engine comprises one or more hollow cylinders each delimiting a combustion chamber into which a mixture of air and fuel is injected. This mixture is compressed in the cylinder by a piston and ignited so as to make the piston move in translation inside the cylinder.

The movement of the pistons in each cylinder of the engine rotates a drive shaft, referred to as a "crankshaft", which, via a transmission system, makes it possible to rotate the wheels of the vehicle. The speed of rotation of the crankshaft defines the engine speed of the vehicle. Specifically, the more the crankshaft turns at a high speed of rotation, the higher the engine speed.

The air of the mixture is injected into the combustion chamber by way of one or more intake valves, each connected to an air intake port. Such intake valves are regularly opened and closed, so as to allow the passage of a predetermined quantity of air emanating from an air box connected upstream to an external-air intake and downstream to one or more housings comprising at least one opening valve, commonly denoted "butterfly valve", mounted to rotate about an axis. Such a housing, known by the name of "butterfly valve housing", is configured to allow the intake of air into the intake port of a combustion chamber of a cylinder of the engine.

The butterfly valve is configured to be opened or closed so as to allow the passage of a quantity of air as a function of the opening angle of the butterfly valve, such an opening angle being measured by an angular position sensor known by the name TPS, standing for "Throttle Position Sensor". For this purpose, the butterfly valve is driven to rotate by an actuator comprising an electric motor controlled by the vehicle computer and connected to a plurality of gears allowing the butterfly valve to be driven to rotate about its axis.

In a known way, when the driver of the vehicle presses on the accelerator pedal, the information is sent to the vehicle computer, which controls the electric motor of the butterfly valve housing so as to control the opening of the butterfly valve. Such an opening of the butterfly valve allows a larger quantity of air to be let into the combustion chamber. The computer then in parallel controls the fuel injection system of the vehicle on the basis of the reading of the flow rate of air sucked into the combustion chamber, which is measured by means of a flow rate measurement sensor mounted in the butterfly valve housing. In the event of acceleration, a larger quantity of fuel is injected into the combustion chamber, then resulting in an increase in the power of the engine. In the case of a motor vehicle, the engine speed fluctuates as a function, for example, of the speed of the vehicle or of the torque required of the engine to maintain its speed, for example when the vehicle is traveling uphill.

However, engines are also known in which the speed must remain constant in order to operate. Specifically, in a known way, a vehicle operating at constant speed, for example a generator or a lawnmower, must maintain a regular speed so as to limit malfunctions. By way of example, it is appropriate to limit the fluctuations in the energy provided by a generator, an increase in which may lead to damage to the equipment electrically connected to said generator. Likewise, in the case of a lawnmower, it is necessary to control the engine speed in order to avoid a high deceleration of the engine when the lawnmower encounters tall grass, for example.

To achieve that, it is known practice to use a mechanical or electronic regulating system in order to allow the engine speed to be regulated.

Some engines are equipped for example with a carburetor, the main function of which is to modulate the quantity of mixture of air and fuel introduced into the combustion chamber. To achieve that, the carburetor is connected to the crankshaft by a tensioned spring. When the engine speed decreases, for example in the case of a lawnmower encountering tall grass, the crankshaft turns at a much lower speed and releases the spring connected to the carburetor, resulting in the regulating butterfly valve being opened so as to increase and re-establish once again the speed of the engine.

However, such systems require the engine speed to fluctuate appreciably in order to operate, which presents a major disadvantage. Specifically, when the regulating systems start to operate, the speed has already collapsed. Thus, the regulation of the speed cannot be instantaneous and the engine speed is re-established progressively, which particularly presents risks of engine deterioration.

It is also known practice to use an electronic regulating system for the butterfly valve, for example applications integrated in the vehicle computer and configured to electronically control the angular position of the butterfly valve, and hence to reduce the intake of air into the combustion chamber so as to limit the engine speed. By way of example, when the vehicle computer detects an increase in the engine speed, the application controls the closure of the regulating butterfly valve so as to limit the air/fuel mixture quantity introduced into the combustion chamber and thus reduce the engine speed.

However, a response time is necessary for the application to be activated and to start controlling the position of the actuator, regularly resulting in the engine speed being exceeded and in temporary oscillations thereof. Now, this exceeding of the speed and these oscillations can pose a risk of premature wear to the engine, thus presenting significant disadvantages here again.

Moreover, the regulating systems of the prior art control the speed of the engine by controlling a predetermined angular position of the butterfly valve that does not necessarily correspond to the load necessary to re-establish the speed of the engine. Such regulating systems thus operate by trial and error by regularly readjusting the load allowing regulation of the engine speed as a function of the response made to the preceding load. Such successive steps may require a significantly long time, thus increasing the risks of damaging the engine.

SUMMARY OF THE INVENTION

The object of the invention is therefore that of overcoming these disadvantages at least in part by proposing a simple, reliable, effective and rapid solution for controlling the engine speed.

The invention is targeted in particular to a method making it possible to adapt rapidly to the application of an external load applied to the engine that modifies the speed thereof.

One objective is to evaluate the load applied to the engine and to react directly to the opening of the butterfly valve by providing the combustion drive torque (indicated torque) and by avoiding waiting for a speed deviation.

Another objective is to reduce or even to avoid the pumping phenomena when the engine load disappears or is strongly reduced.

To this end, the invention relates first of all to a method for controlling a speed of a vehicle combustion engine, intended to operate at a constant speed, said engine comprising at least one combustion chamber, into which a mixture of air and fuel is injected, and an air box, configured to inject the air into said combustion chamber and having an air flow rate controlled by a regulating butterfly valve, said regulating butterfly valve having a variable angular position, controlled by a predetermined position of an actuator, said method being characterized in that it comprises the steps of:

- evaluating a so-called "load" resistant torque resulting from at least one external load (in particular a plurality of external loads) applied to said engine, so as to compensate for said load resistant torque,
- determining, from said evaluated load resistant torque, a position of said actuator so as to determine an angular position of the regulating butterfly valve, and
- controlling the actuator in the position determined from said evaluated load resistant torque, so as to control said constant speed of the engine, in order to avoid sudden variations in said speed of the engine, said method additionally comprising the following steps:

- predetermining a curve of the so-called "theoretical" engine torque due to the combustion in the combustion chamber during the engine cycle, representing the evolution of a complete engine cycle comprising at least one combustion phase, said curve comprising:
  - a first portion comprising said at least one combustion phase, representative of a variation in the torque during the combustion phase, for calculating a combustion drive torque, and
  - a second portion not comprising said at least one combustion phase, representative of the load resistant torque, for evaluating the latter.

The method according to the invention advantageously makes it possible to anticipate any collapse of the engine speed by controlling an anticipated angular position of the regulating butterfly valve, making it possible to compensate for such a collapse at the moment when it occurs. For example, by defining separate engine control processes if the engine is essentially under load, for example with clutched blades on a lawnmower, or essentially not under load, for example with unclutched blades in the case of a lawnmower, and by virtue of dividing the theoretical torque reference curve as defined, said method makes it possible for the engine control not only to better react in the event of a sudden load variation, for example on the cutting blade or blades, by avoiding a collapse or a runaway of the engine speed, but also to reduce or even avoid a so-called pumping phenomenon when the engine is not under load or supports a weak load, for example when the cutting blade or blades is/are unclutched in the case of a lawnmower.

Preferably, the method according to the invention additionally comprises the following steps:

- determining a first estimator from said evolution curve of the theoretical drive torque, corresponding to a succession of segments connected by a plurality of inflection points, each segment being representative of a variation in values of the theoretical drive torque during a combustion phase in a combustion chamber, and additionally comprising an initial point and a final point, for calculating the combustion drive torque,
- determining a second estimator from said evolution curve of the theoretical drive torque, corresponding to a succession of segments connected by two inflection points, each segment being situated in a zero or substantially zero torque region of the evolution curve of the theoretical drive torque, and comprising an initial point and a final point, for evaluating the load resistant torque.

The use of linear segments makes it possible to simplify the calculations by using only additions and subtractions, thereby making it possible in particular to avoid the use of corrective coefficients on instants corresponding to determined angular positions of the crankshaft defining said points.

Preferably, the step of evaluating the load resistant torque comprises the substeps of:

- calculating a so-called "acceleration" drive torque resulting from an acceleration of the engine,
- determining a so-called "friction" resistant torque resulting from a plurality of frictions in the engine,
- calculating said combustion drive torque resulting from the combustion of said mixture of air and fuel in said at least one combustion chamber, and
- calculating the load resistant torque from the combustion drive torque, the acceleration drive torque and the friction resistant torque.

In a preferred manner, with said engine comprising a crankshaft characterized by an angular position starting from a reference position, and said at least one combustion chamber having a combustion phase, the calculation of the combustion drive torque comprises the steps of:

- determining a first estimator from the curve of said theoretical drive torque, said first estimator corresponding to a succession of segments, connected to one another between an initial point and a final point, and characterized by a plurality of notable points, each segment being representative of a variation in values in the torque during the combustion phase, said plurality of notable points comprising the initial point, a plurality of inflection points connecting the segments to one another, and the final point,
- correlating between the initial point, each inflection point and the final point and an angular position of the crankshaft,
- measuring a plurality of instants, each instant corresponding to an angular position of the crankshaft, and
- calculating the combustion drive torque from said plurality of measured instants.

Such steps of calculating the combustion drive torque allow a realistic calculation of the combustion drive torque that is carried out in a simple manner by means of the known sensor allowing the determination of the position of the crankshaft.

According to a preferred aspect of the invention, with the engine having a complete engine cycle comprising at least one combustion phase, and said curve of the theoretical drive torque representing the evolution of the complete engine cycle, the determination of said first estimator is carried out for a first portion of said curve of the theoretical drive torque comprising said at least one combustion phase, so as to determine said first estimator of said first curve portion of the theoretical drive torque.

Preferably, with the first curve portion of the theoretical drive torque comprising the initial point, four inflection points and the final point, the first estimator depends on six instants and allows the calculation of the combustion drive torque from a first equation written in the following way:

$$TQ_Ind=k*(T6-T5-T4+T3+T2-T1)*N^3$$

in which:

- k is a factor dependent on the inertia of the combustion engine,
- N [rpm] corresponds to an engine speed measured by means of the angular position of the crankshaft during the engine cycle,
- T1 [ms] corresponding to the instant of the initial point of the first estimator,
- T2 to T5 [ms] respectively corresponding to the instants of the four inflection points from the initial point to the final point of the first estimator, and
- T6 [ms] corresponding to the instant of the final point of the first estimator.

Such a calculation advantageously allows the determination of the combustion drive torque by means of a simple calculation dependent on a plurality of instants which can be determined by means of a clock integrated in the computer and triggered for a precise position of the crankshaft.

Alternatively, with the engine having a complete engine cycle comprising at least one combustion phase, and said curve of the theoretical drive torque representing the evolution of the complete engine cycle, the calculation of the load resistant torque is carried out for a second portion of said curve of the theoretical drive torque not comprising said at least one combustion phase and comprises an estimation, from a second estimator, of a load resistant torque based on the taking into account of the notable instants of said second curve portion of the theoretical drive torque, and a determination of the position of the actuator as a function of this evaluated load resistant torque and of the engine rotation speed.

According to a preferred aspect of the invention, in this alternative embodiment, with the second curve portion of the theoretical drive torque comprising, as notable instants, the initial point, two inflection points and the final point, the second estimator depends on four instants and allows the calculation of the load resistant torque from a second equation written in the following way:

$$TQ_\mathrm{Load}=k*(T4-T3-T2+T1)*N^3$$

in which:

- k is a factor dependent on the inertia of the combustion engine,
- N corresponds to an engine speed measured by means of the angular position of the crankshaft during the engine cycle, and
- T1 corresponding to the instant of the initial point of the second estimator,
- T2 and T3 respectively corresponding to the instants of the two inflection points from the initial point to the final point of the second estimator, and
- T4 corresponding to the instant of the final point of the second estimator.

Such a calculation advantageously allows the direct determination of the load resistant torque by means of a simple calculation dependent on a plurality of instants which can be determined by means of a clock integrated in the computer and triggered for a precise position of the crankshaft.

Alternatively, in an advantageous manner, the angular position of the regulating butterfly valve is determined from a double entry table dependent on the engine speed and on the load resistant torque. Such an alternative embodiment advantageously makes it possible to anticipate an angular position of the regulating butterfly valve by simple determination of such an angular position from the known engine speed and from the load resistant torque.

Preferably, the friction resistant torque corresponds to a predetermined torque value.

The invention also relates to a vehicle computer, said vehicle comprising a combustion engine intended to operate at a constant speed, said combustion engine comprising at least one combustion chamber, into which a mixture of air and fuel is injected, and an air box, configured to inject the air into said combustion chamber and having an air flow rate controlled by a regulating butterfly valve, said regulating butterfly valve having a variable angular position, controlled by a predetermined position of an actuator, said computer being configured to:

- evaluate a so-called "load" resistant torque resulting from a plurality of external loads applied to said engine,
- determine, from said evaluated load resistant torque, a position of said actuator, so as to determine an angular position of the regulating butterfly valve, and
- control the actuator in the position determined from said evaluated load resistant torque, so as to regulate the constant engine speed,
- predetermine a curve of the so-called "theoretical" drive torque due to the combustion in the combustion chamber during the engine cycle, representing the evolution of a complete engine cycle comprising at least one combustion phase, said curve comprising:
  - a first portion comprising said at least one combustion phase, representative of a variation in the torque during the combustion phase, for calculating a combustion drive torque, and
  - a second portion not comprising said at least one combustion phase, representative of the load resistant torque, for evaluating the latter.

According to one aspect of the invention, the computer is configured to:

- determine a first estimator from said evolution curve of the theoretical drive torque, corresponding to a succession of segments connected by a plurality of inflection points, each segment being representative of a variation in values of the theoretical drive torque during a combustion phase in a combustion chamber, and comprising an initial point and a final point, for calculating the combustion drive torque,
- determine a second estimator from said evolution curve of the theoretical drive torque, corresponding to a succession of segments connected by two inflection points, each segment being situated in a zero or substantially zero torque region of the evolution curve of the theoretical drive torque, and comprising an initial point and a final point, for evaluating the load resistant torque.

In a preferred manner, with said engine comprising a crankshaft characterized by an angular position starting from a reference position, and said at least one combustion chamber having a combustion phase, in order to calculate the combustion drive torque, the computer is configured to:

determine a first estimator from said evolution curve of the theoretical drive torque, the estimator corresponding to a succession of segments, connected to one another between an initial point and a final point, and characterized by a plurality of notable points, each segment being representative of a variation in values of the torque during the combustion phase, said plurality of notable points comprising the initial point, a plurality of inflection points connecting the segments to one another, and the final point, correlate the initial point, each inflection point and the final point with an angular position of the crankshaft, measure a plurality of instants, each instant corresponding to an angular position of the crankshaft, and calculate the combustion drive torque from said plurality of measured instants.

According to a preferred aspect of the invention, with the engine having a complete engine cycle comprising at least one combustion phase, and said curve of the theoretical drive torque representing the evolution of the complete engine cycle, the computer is configured to determine said first estimator for a first portion of said curve of the theoretical drive torque comprising said at least one combustion phase, so as to allow the determination of said first estimator of said first curve portion of the theoretical drive torque.

Preferably, with the first curve portion of the theoretical drive torque comprising the initial point, four inflection points and the final point, the computer is configured to determine the first estimator from six instants and to calculate the combustion drive torque (TQ_Ind) from a first equation written in the following way:

$$TQ_Ind=k*(T6-T5-T4+T3+T2-T1)*N^3$$

in which:

k is a factor dependent on the inertia of the combustion engine,

N corresponds to an engine speed measured by means of the angular position of the crankshaft during the engine cycle, T1 corresponding to the instant of the initial point of the first estimator, T2 to T5 respectively corresponding to the instants of the four inflection points from the initial point to the final point of the first estimator, and T6 corresponding to the instant of the final point of the first estimator.

Alternatively, with the engine having a complete engine cycle comprising at least one combustion phase, and said curve of the theoretical drive torque representing the evolution of the complete engine cycle, the computer is configured to determine a second estimator for a second portion of said curve of the theoretical drive torque not comprising said at least one combustion phase.

According to a preferred aspect of the invention, in this alternative embodiment, with the second curve portion of the theoretical drive torque comprising the initial point, two inflection points and the final point, the computer is configured to determine the second estimator from four instants and to calculate the load resistant torque TQ_Load from a second equation written in the following way:

$$TQ_Load=k*(T4-T3-T2+T1)*N^3$$

in which:

k is a factor dependent on the inertia of the combustion engine,

N corresponds to an engine speed measured by means of the angular position of the crankshaft during the engine cycle, and T1 corresponding to the instant of the initial point of the second estimator, T2 and T3 respectively corresponding to the instants of the two inflection points from the initial point to the final point of the second estimator, and T4 corresponding to the instant of the final point of the second estimator.

Such a calculation advantageously allows the determination of the load resistant torque by means of a simple calculation dependent on a plurality of instants which can be determined by means of a clock integrated in the computer and triggered for a precise position of the crankshaft.

Alternatively, in an advantageous manner, the computer is configured to determine the angular position of the regulating butterfly valve from a double entry table dependent on the engine speed and on the load resistant torque.

Advantageously, the computer is configured to calculate the acceleration drive torque from the inertia and the average engine speed of said combustion engine.

Preferably, the computer is configured to determine the friction resistant torque from a predetermined torque value.

The invention additionally concerns a vehicle comprising an engine, having a constant engine speed, and a computer as described above.

Finally, the invention comprises an electric generator comprising an engine, having a constant engine speed, and a computer as described above.

BRIEF DESCRIPTION OF THE DRAWINGS

Further features and advantages of the invention will become more clearly apparent from reading the following description. This description is purely illustrative and should be read with reference to the attached drawings, in which:

FIG. 1 schematically illustrates a combustion engine and a regulating butterfly valve of an air box of such a combustion engine.

FIG. 2 is a schematic view of the exchanges of messages and signals between the computer and the engine of the vehicle.

FIG. 3 depicts the evolution of the so-called "theoretical" drive torque in a combustion chamber.

FIG. 4 illustrates a first estimator of the evolution of the drive torque of FIG. 3.

FIG. 5 illustrates a second estimator of the evolution of the load torque of FIG. 3.

FIG. 6 schematically illustrates one embodiment of the method according to the invention.

DESCRIPTION OF THE PREFERRED EMBODIMENTS

The system and the method according to the invention are presented below for the purpose of an implementation in a generator or a lawnmower. However, any implementation in a different context, in particular for any vehicle comprising an engine of which the speed must be constant, is also covered by the invention As described above, with reference to FIG. 1, a vehicle, of the lawnmower type for example, comprises a combustion engine 1 comprising at least one hollow cylinder 11, in this example a single cylinder 11 delimiting a combustion chamber 11A in which there slides a piston 12 of which the movement is driven by compression and expansion of the gases obtained from the combustion of a mixture of air and fuel introduced into the combustion chamber 11A. The piston 12 is connected to a crankshaft 13, which, rotated by the upstroke and downstroke of the piston 12, allows the engine 1 of the vehicle to be driven.

The speed of rotation of the crankshaft 13 defines the engine speed of the vehicle, that is to say the number of rotations per minute performed by the crankshaft 13 when the engine 1 is operating. In the case of a lawnmower or of a generator for example, it is appropriate for such an engine speed to be constant. Thus, the torque of the engine 1 must be adapted to ensure that the speed remains unchanged whatever the external conditions. Specifically, the torque of the engine 1 corresponds to the force that the engine 1 must provide for example to ensure that the crankshaft 13 turns at the desired speed of rotation, that is to say in this case at the predefined constant speed.

The measurement of the speed of rotation of the crankshaft 13 is determined from the angular position of such a crankshaft 13. In order to know such an angular position, still with reference to FIG. 1, the crankshaft 13 comprises a toothed wheel 130 comprising a predetermined number of regularly spaced teeth along with a space free of teeth corresponding to a reference position of the crankshaft 13. Since such a toothed wheel 130 is known per se, it will not be described in more detail here.

A position sensor 16 is mounted facing the toothed wheel 130 so as to allow both the detection of the reference position and the counting of the number of teeth running in front of the position sensor 16 from such a reference position. More specifically, the position sensor 16 delivers a signal representative of the passage of the teeth which allows the computer 30 to determine the angular position from 0° to 360° of the crankshaft 13.

It will be recalled that, in such an engine 1, the air and the fuel are respectively introduced and expelled via intake valves 14A and exhaust valves 14B, connected to a camshaft 15. The camshaft 15, caused to rotate, alternately allows the opening and the closing of the intake valves 14A and exhaust valves 14B, respectively sliding in an intake port 16A and an exhaust port 16B. Each intake port 16A allows the passage of the air from an air intake system up and into the combustion chamber 11A of the cylinder 11.

For that purpose, the air intake system comprises a butterfly valve housing 20 connected to an air box 22. The air box 22 is configured to suck in a stream of air emanating upstream from the exterior of the vehicle and to introduce it into the air intake port 16A connected to the combustion chamber 11A.

In order to regulate the flow rate of the stream of air, still with reference to FIG. 1, the butterfly valve housing 20 comprises a regulating butterfly valve 21, taking the form of a shut-off valve, configured to permit or stop the passage of the air. The invention is described, in this example, for a butterfly valve housing 20 comprising a single regulating butterfly valve 21; however, it goes without saying that the butterfly valve housing 20 could comprise a different number thereof, in particular in the case of an engine 1 comprising a plurality of combustion chambers 11A and therefore a plurality of intake ports 16A.

In order to allow the regulation of the flow rate of the stream of air, the regulating butterfly valve 21 is mounted to rotate about an axis and is configured to change between an open position, in which the air flow rate in the butterfly valve housing 20 is at a maximum, and a closed position, in which such an air flow rate is zero.

The position of the regulating butterfly valve 21 is driven to rotate by an actuator 23 comprising an electric motor controlled by the vehicle computer 30 and connected to a plurality of gears allowing the regulating butterfly valve 21 to be driven to rotate about its axis.

In the case of an engine 1 operating at constant speed, the invention advantageously makes it possible to control, in phase advance, the position of the actuator 23, so as to control the angular position of the regulating butterfly valve 21, with the aim of limiting the fluctuations in the engine speed. Specifically, the invention makes it possible to prevent the fluctuations in the engine speed by anticipating the control of the angular position of the regulating butterfly valve 21.

For that purpose, the vehicle comprises a computer 30 configured to allow the implementation of the method according to the invention.

Specifically, according to a preferred embodiment of the invention, the vehicle computer 30 is configured to evaluate a so-called "load" resistant torque, denoted TQ_Load, resulting from a plurality of external loads applied to said engine 1, with the aim of compensating for such an external load. In the example of the lawnmower, when the latter encounters tall grass, for example, the increase in the height and therefore in the density of the grass to be cut would cause the collapse of the engine speed. The determination of the load resistant torque TQ_Load advantageously makes it possible to anticipate such a collapse by controlling an anticipated angular position of the regulating butterfly valve 21, making it possible to compensate for such a collapse before it occurs.

The computer 30 is then additionally configured to determine, from the evaluated load resistant torque TQ_Load, a position of the actuator 23, so as to determine an angular position of the regulating butterfly valve 21, and to control such a position of the actuator 23, so as to allow the regulation of the engine speed.

The load resistant torque TQ_Load is, according to a preferred embodiment of the invention, evaluated in the following way:

$$TQ_{Load}=TQ_Ind-TQ_Fr-TQ_Acc$$

where:

TQ_Ind [N.m]: so-called "combustion" drive torque resulting from the combustion of the mixture of air and fuel in the combustion chamber 11A, TQ_Fr [N.m]: so-called "friction" drive torque resulting from a plurality of frictions acting in the engine 1, TQ_Acc [N.m]: so-called "acceleration" drive torque resulting from an acceleration of the engine 1.

Thus, in order to evaluate the load resistant torque TQ_Load, the computer 30 is configured simultaneously for calculating the acceleration drive torque TQ_Acc, determining the friction resistant torque TQ_Fr and calculating the combustion drive torque TQ_Ind.

For that purpose, with reference to FIG. 2, the computer 30 is configured to receive, from the position sensor 16 of the toothed wheel 130 of the crankshaft 13, a signal representative of the passage of the teeth allowing the computer 30 to determine the angular position from 0° to 360° of the crankshaft 13 from the detection of the reference position. The computer 30 is then configured to determine the speed of rotation of the crankshaft 13 from the evolution of the angular position of said crankshaft 13 for a predetermined duration.

In addition, with the inertia of the engine 1 being predetermined and known, the computer 30 is configured to determine the acceleration drive torque TQ_Acc from the speed of rotation of the crankshaft 13 and from the inertia of the engine 1. According to one exemplary embodiment, the computer 30 is configured to calculate the acceleration drive torque TQ_Acc from the following equation:

$$TQ_{Acc} = J * \frac{d\omega}{dt} = J_N * N * (N_n - N_{n-1})$$

where:

J: inertia of the engine in kg.m$^2$ $J_N$: inertia of the engine in N.m/rpm$^2$ $\frac{d\omega}{dt}$:

acceleration of the crankshaft in rad/s$^2$

N: engine speed ($N_n$ and $N_{n-1}$ representing the engine speed at one revolution n and at one revolution n−1) in rpm.

The friction resistant torque TQ_Fr represents the drive torque resulting from a plurality of frictions acting in the engine 1 and corresponds in this example to a predetermined known term. Specifically, the computer 30 is configured for example to store such a value of friction resistant torque TQ_Fr so as to directly incorporate the value in the calculation of the load resistant torque TQ_Load.

Moreover, in order to determine the combustion drive torque TQ_Ind, the computer 30 is configured to:

- determine a first estimator from an evolution curve of a theoretical drive torque TQ_T, the first estimator corresponding to a succession of segments connected by a plurality of inflection points, each segment being representative of a variation in values of the torque during a combustion phase of the engine cycle, the first estimator additionally comprising an initial point and a final point,
- perform a correlation between the initial point, each inflection point and the final point and an angular position of the crankshaft 13,
- measure a plurality of instants, each instant corresponding to an angular position of the crankshaft 13, and
- calculate the combustion drive torque TQ_Ind from the measured instants.

Specifically, FIG. 3 depicts an example of the theoretical evolution of the drive torque TQ_T due to the combustion of the mixture of air and fuel in the combustion chamber 11. The example depicted in FIG. 3 illustrates such an evolution for an engine 1 comprising two cylinders 11 and therefore two combustion chambers 11A. Thus, the two phases P1, P3 of negative peaks depicted on the curve respectively illustrate the compression of the mixture of air and fuel in the first combustion chamber 11A (P1) and the compression of the mixture of air and fuel in the second combustion chamber 11A (P3), and the two evolution phases P2, P4 of positive peaks depicted on the curve respectively illustrate the combustion of such a mixture in the first combustion chamber 11A (P2) and the combustion of such a mixture in the second combustion chamber 11A (P4).

In this example, an engine cycle CM, that is to say the combustion of the mixture of air and fuel in the two combustion chambers 11A of the engine 1, thus comprises two combustion phases and is carried out for a quarter-turn of the crankshaft 13, that is to say a rotation of 90° of said crankshaft 13.

This evolution curve of the so-called theoretical drive torque TQ_T, depicted in FIG. 3, is known and can be advantageously predetermined or determined in advance. The evolution curve of the drive torque TQ_T can be obtained in a known way, that is to say preferably theoretically from combustion equations, but also, alternatively, by measuring the torque during a precalibration of the engine, for example on the basis of a pressure sensor placed in each combustion chamber of the engine and of a transformation into drive torque, during a complete engine cycle CM. This torque has been termed "theoretical" in the present document for the preferred way of obtaining it by the theoretical route; it is clear that if it is measured, it is no longer "theoretical" in the strict sense of the term but maintains its reference character. The solution of the measurement of this torque is entirely conceivable for an application of the method according to the invention.

The curve of the theoretical drive torque TQ_T, determined in advance as explained above, and depicted in FIG. 3, comprises:

- a first portion comprising said at least one combustion phase, representative of a variation in the torque during the combustion phase, for calculating the combustion drive torque TQ_Ind, and
- a second portion not comprising said at least one combustion phase, representative of the load resistant torque TQ_Load, for evaluating the latter.

With reference to FIGS. 4 and 5, the computer 30 is configured to respectively determine a first and a second estimator from such an evolution. According to a preferred embodiment, the first estimator is for example realized on the basis of the zero-mean convolution of the curve representing the evolution of the theoretical torque TQ_T in the combustion chamber 11A. Specifically, the convolution product of the evolution of the torque TQ_T in the combustion chamber 11A is proportional to the combustion drive torque TQ_Ind. Such a convolution product is known per se and will not be described in more detail in this document.

In a preferred manner, two embodiments can be implemented by the computer described above. In the example of the lawnmower, these two embodiments respectively correspond to a lawnmower in which the blades are engaged or clutched (first embodiment), that is to say that external forces are applied to the blade and therefore to the engine, and to a lawnmower in which the blades are free or unclutched (second embodiment), that is to say nonengaged or else that no external force emanating from the cutting blade or blades is applied to the engine.

According to the first embodiment, with reference to FIG. 4, the estimator, denoted first estimator, corresponds to a succession of segments S1, S2, S3, S4, S5 connected by a plurality of inflection points I1, I2, I3, I4, each segment being representative of a variation in values of the torque during a combustion phase in a combustion chamber 11A (that is to say during the phases P1 and P2, for example). Such a first estimator additionally comprises an initial point A and a final point B.

Thus, the first segment S1 represents the estimation of the evolution of the torque TQ_T in the first combustion chamber 11A between the initial point A and the first inflection point I1; the second segment S2 represents the estimation of the evolution of the torque TQ_T between the first inflection point I1 and the second inflection point I2; the third segment S3 represents the estimation of the evolution of the torque TQ_T between the second inflection point I2 and the third inflection point I3; the fourth segment S4 represents the estimation of the evolution of the torque TQ_T between the third inflection point I3 and the fourth inflection point I4; and the fifth segment S5 represents the estimation of the evolution of the torque TQ_T in the first combustion chamber 11A between the fourth inflection point I4 and the final point B.

Each segment, representing a variation in values of the torque, thus has either a negative slope (segment S3) or a positive slope (segments S1 and S5) or a zero slope (segments S2 and S4). According to one exemplary embodiment, since the zero-slope segments do not have a variation in torque values, only the segments in which the slope is not zero are used for determining the combustion drive torque TQ_Ind.

For that purpose, with such a first estimator being realized for a combustion phase of an engine cycle CM, the initial point A, the final point B and each inflection point I1, I2, I3, I4 correspond to a known angular position of the crankshaft 13. Since the speed of rotation of the engine 1 and therefore of the crankshaft 13 are known, each tooth of the toothed wheel 130, that is to say each angular position, corresponds to a given instant from the start of the engine cycle CM. Thus, the computer 30 is configured to record six instants T1, T2, T3, T4, T5 and T6 dependent on the engine 1 and on the engine speed.

By way of example, for a bicylinder engine, in which the two cylinders are offset by a rotation of 90° of the crankshaft 13, the instants T1, T2, T3, T4, T5 and T6 are respectively recorded when the computer 30 detects the following positions of the crankshaft 13: the first instant T1 corresponds to the angular position of the crankshaft 13 at which the piston 12 of the first cylinder 11 passes into a top position, denoted top dead center, and the instant T2 is recorded for a rotation through an angle of 45° starting from the angular position of the crankshaft 13 corresponding to the top dead center of the piston 12 in the first cylinder 11. In a similar manner, the instants T3, T4, T5 and T6 respectively correspond to the instants recorded for a rotation through an angle of 105°, 195°, 255° and 300° starting from the angular position of the crankshaft 13 corresponding to the top dead center position of the piston 12 in the first cylinder 11.

In an advantageous manner, the slopes of the segments defined by the instants T1, T2, T3, T4, T5 and T6 are chosen in such a way that the integral of the curve defined by the succession of segments S1, S2, S3, S4, S5 is zero. That makes it possible to align the positive part of the curve with the positive part of the combustion.

The use of linear segments makes it possible to simplify the calculations by using only additions and subtractions, thereby making it possible in particular to avoid the use of corrective coefficients on the instants T1, T2, T3, T4, T5 and T6.

According to a preferred embodiment of the invention, a clock (not shown) is integrated in the computer 30 so as to allow the recording of the instants T1, T2, T3, T4, T5 and T6 corresponding to each predetermined angular position of the crankshaft 13.

The computer 30 is then configured to calculate three durations d0, d1, d2 corresponding to the three differences of instants relating to the three segments of nonzero slopes, that is to say to the segments S1, S3, S5.

From these durations and therefore from these instants, the combustion drive torque TQ_Ind is calculated in this example according to the following equation:

$$TQ_Ind=k*(d0-d1+d2)*N^3$$

where:

k: known factor dependent on the inertia of the engine, d0: duration [ms] of the first segment S1 having a positive slope, that is to say duration between the instants T1 and T2, d1: duration [ms] of the third segment S3 having a negative slope, that is to say duration between the instants T3 and T4, d2: duration [ms] of the fifth segment S5 having a positive slope, that is to say duration between the instants T5 and T6, and N: engine speed [rpm] measured by means of the position sensor 16 of the toothed wheel 130.

Thus, such an equation can also be written in the following way:

$$TQ_Ind=k*[(T2-T1)-(T4-T3)+(T6-T5)]*N^3$$

that is to say: $TQ_Ind=k*(T6-T5-T4+T3+T2-T1)*N^3$

The computer 30 thus makes it possible, as described above, to evaluate the combustion drive torque TQ_Ind.

In the second embodiment, with reference to FIG. 5, the estimator, denoted second estimator, corresponds to a succession of segments S1, S2, S3 connected by two inflection points I1, I2, all of the segments being situated in the part of the theoretical drive torque TQ_T with zero or substantially zero value. Such a second estimator additionally comprises an initial point A and a final point B. Such a second estimator then makes it possible to directly determine the load resistant torque TQ_Load.

Thus, the first segment S1 represents the estimation of the evolution of the torque TQ_T between the initial point A and the first inflection point I1; the second segment S2 represents the estimation of the evolution of the torque TQ_T between the first inflection point I1 and the second inflection point I2; and the third segment S3 represents the estimation of the evolution of the torque TQ_T between the second inflection point I2 and the final point B.

Since the three segments are situated in the region of zero theoretical torque, the result of the convolution product is insensitive to the combustion torque and is sensitive only to the load resistant torque.

Each segment, representing a variation in values of the torque, then has either a negative slope (segment S3) or a positive slope (segment S1) or a zero slope (segment S2). Since the zero-slope segments do not have a variation in torque values, only the segments in which the slope is not zero are, in this example, used to determine the load resistant torque TQ_Load.

For that purpose, in a similar manner to the first estimator, with a second estimator being realized during an engine cycle, the initial point A, the final point B and each inflection point I1, I2 correspond to a known position of the crankshaft 13, that is to say correspond to a precise tooth of the toothed wheel 130 of the crankshaft 13. Since the speed of rotation of the engine 1 and therefore of the crankshaft 13 are known, each tooth of the toothed wheel 130 corresponds to a given instant from the starting of the engine cycle CM. Thus, the computer 30 is configured to record four instants T1, T2, T3, T4 dependent on the engine 1 and on the engine speed.

By way of example, for a bicylinder engine, in which the two cylinders are offset by a rotation of 90° of the crankshaft 13, the instants T1, T2, T3 and T4 are respectively recorded when the computer 30 detects the following positions of the crankshaft 13: the first instant T1 is recorded for a rotation through an angle of 270° starting from the angular position of the crankshaft 13 corresponding to the top dead center of the piston 12 in the second cylinder 11; the instant T2 is recorded for a rotation through an angle of 315° starting from the angular position of the crankshaft 13 corresponding to the top dead center of the piston 12 in the second cylinder 11; the instant T3 is recorded for a rotation through an angle of 390° starting from the angular position of the crankshaft 13 corresponding to the top dead center of the piston 12 in the second cylinder 11; and the instant T4 is recorded for a rotation through an angle of 435° starting from the angular position of the crankshaft 13 corresponding to the top dead center of the piston 12 in the second cylinder 11.

According to a preferred refinement of this second embodiment of the invention, a clock (not shown) is integrated in the computer 30 so as to allow the recording of the instants T1, T2, T3, T4 corresponding to each predetermined angular position of the crankshaft 13.

The computer 30 is then configured to calculate two durations d0, d1 corresponding to the two differences of instants relating to the two segments of nonzero slopes, that is to say to the segments S1, S3.

From these durations and therefore from these instants, the load resistant torque TQ_Load is calculated in this example according to the following equation:

$$TQ_\text{Load}=k*(d0-d1)*N^3$$

where:

k: known factor dependent on the inertia of the engine, d0: duration in milliseconds of the first segment S1 having a positive slope, that is to say duration between the instants T1 and T2, d1: duration in milliseconds of the third segment S3 having a negative slope, that is to say duration between the instants T3 and T4, and N: engine speed in rpm (revolutions per minute) measured by means of the position sensor 16 of the toothed wheel 130.

Thus, such an equation can also be written in the following way:

$$TQ_{Load}=k*(T4-T3-T2+T1)*N^3$$

The computer 30 thus makes it possible, as described above, to directly evaluate the load resistant torque TQ_Load.

With reference to FIG. 6, there will now be presented a method for controlling the speed of an engine, operating at constant speed, according to the first embodiment described above, in which the estimator determined for calculating the combustion drive torque TQ_Ind corresponds to the first estimator described above (blades engaged or clutched). In this first embodiment, the estimator is thus realized during a combustion phase of an engine cycle CM.

First of all, in a step E0, the computer 30 evaluates whether the blades of the lawnmower are engaged or not, for example by means of a clutch sensor, then calculates, in a step E1, the load resistant torque TQ_Load, determines, in a step E2, from said calculated load resistant torque TQ_Load, a position of the actuator 23, so as to determine an angular position of the regulating butterfly valve 21, and controls, in a step E3, the actuator 23 in said position so as to control said engine speed.

If the computer detects, in step E0, that the blades are engaged/clutched, the load resistant torque TQ_Load is evaluated simultaneously from the acceleration drive torque TQ_Acc, calculated from the speed of rotation of the crankshaft 13 and inertia of the engine 1, from the friction resistant torque TQ_Fr corresponding to a predetermined value, a function of the engine, and from the combustion drive torque TQ_Ind.

In this case, in a preferred manner, in step E1, the method comprises a first substep F1 of calculating the acceleration drive torque TQ_Acc, followed by a second substep F2 of determining the friction resistant torque TQ_Fr.

Step E1 then comprises a substep F3 of determining a first torque estimator characterized by an initial point A, a final point B and one or more inflection points I1, I2, I3, I4 occurring at a plurality of instants, in this example six instants T1, T2, T3, T4, T5, T6.

The computer 30 correlates, in a substep F4, the initial point A, the final point B and each inflection point I1, I2, I3, I4 with an angular position of the crankshaft 13, and therefore with a given instant T1, T2, T3, T4, T5, T6.

The computer 30 measures, in a substep F5, each instant T1, T2, T3, T4, T5, T6 by means of a clock. For example, in practice, the clock transmits each instant to the computer 30 when one of the predetermined angular positions of the crankshaft 13 is detected by means of the position sensor 16.

The computer then calculates, in a substep F6, the combustion drive torque TQ_Ind from the measured instants T1, T2, T3, T4, T5 and T6, as described above.

Next, in step E2, the computer 30 determines, from the calculated load resistant torque TQ_Load, a position of the actuator 23, so as to determine an angular position of the regulating butterfly valve 21.

The computer 30 then controls, in step E3, the actuator 23 in the determined position so as to control the engine speed and anticipate a runaway or a collapse.

By way of example, the angular position of the regulating butterfly valve 21 can be determined from a double entry table dependent on the engine speed and on the load resistant torque TQ_Load. Specifically, such a table can, according to one exemplary embodiment, be created experimentally or theoretically and stored in the computer 30 of the vehicle. Once the engine speed is known and the load resistant torque TQ_Load has been calculated, the computer 30 can be configured to read the value of the angular position of the regulating butterfly 21 directly from the table and apply such an angular position, via a position of the actuator 23.

If the computer 30 detects, in step E0, that the blades are not engaged, the computer 30 uses, in step E1, a second estimator for evaluating the load resistant torque TQ_Load.

In this case, in a preferred manner, in step E1, the method comprises an estimation of the load torque based on the taking into account of the notable instants T1, T2, T3, T4 of the second curve portion. More precisely, a second estimator is determined and a plurality of instants, in this example four instants T1, T2, T3, T4, are recorded by the computer 30 by correlating the initial point A, the final point B and each inflection point I1, I2 with an angular position of the crankshaft 13, and therefore with a given instant. The instants T1, T2, T3, T4 are measured by means of a clock which transmits each instant to the computer 30 when one of the predetermined angular positions of the crankshaft 13 is detected by means of the position sensor 16.

Next, in step E2, the computer 30 determines, from the estimated load resistant torque TQ_Load and from the engine rotation speed, a position of the actuator 23, so as to determine an angular position of the regulating butterfly valve 21.

The computer 30 then controls, in step E3, the actuator 23 in the determined position so as to control the engine speed and anticipate a runaway or a collapse.

Such a method advantageously allows a rapid and reactive adaptation of the engine speed, making it possible to anticipate for example a collapse of the engine speed, without waiting for the variation in such an engine speed in order to compensate for it. The method according to the invention thus makes it possible to limit the fluctuations in the engine speed, making it possible to limit the risks of damage to such an engine and, where appropriate, to equipment powered by the engine.

The invention claimed is:

1. A method for controlling a speed of a vehicle combustion engine configured to operate at a constant speed, said vehicle combustion engine including at least one combustion chamber into which a mixture of air and fuel is injected, and an air box configured to inject the air into said at least one combustion chamber, the air box having an air flow rate controlled by a regulating butterfly valve, said regulating butterfly valve having a variable angular position controlled by a predetermined position of an actuator, said method comprising:

evaluating a load-resistant torque resulting from at least one external load applied to said engine to compensate for said load-resistant torque;

determining, from said evaluated load-resistant torque, a position of said actuator to determine an angular position of the regulating butterfly valve;

controlling the actuator in the position determined from said evaluated load-resistant torque to control said constant engine speed; and predetermining an evolution curve of a theoretical drive torque due to combustion in the combustion chamber during the engine cycle, representing an evolution of a complete engine cycle comprising at least one combustion phase, said evolution curve comprising:

a first portion including said at least one combustion phase, representative of a variation in the torque during the at least one combustion phase, to calculate a combustion drive torque, and a second portion that does not include said at least one combustion phase, representative of the load-resistant torque, to evaluate the load-resistant.

2. The method as claimed in claim 1, wherein said vehicle combustion engine includes a crankshaft having an angular position starting from a reference position, said at least one combustion chamber having the combustion phase, the calculating the combustion drive torque comprising:

determining a first estimator from said evolution curve of said theoretical drive torque, said first estimator corresponding to a succession of segments connected to one another between an initial point and a final point and comprising a plurality of notable points, each of the segments being representative of a variation in values of the combustion drive torque during the at least one combustion phase, said plurality of notable points comprising the initial point, a plurality of inflection points connecting the segments to one another, and the final point, correlating the initial point, each of the inflection points, and the final point, with the angular position of the crankshaft, measuring a plurality of instants, each of the instants corresponding to the angular position of the crankshaft, and calculating the combustion drive torque from said plurality of measured instants.

3. The method as claimed in claim 2, wherein the engine has a complete engine cycle comprising the at least one combustion phase, said evolution curve of the theoretical drive torque representing the evolution of the complete engine cycle, and the determining the first estimator is carried out for the first portion of said evolution curve of the theoretical drive torque comprising said at least one combustion phase.

4. The method as claimed in claim 3, wherein the first portion of the theoretical drive torque comprises the initial point, four of the inflection points, and the final point, the first estimator depends on six of the instants and calculates the combustion drive torque from the following equation:

$$TQ_Ind=k*(T6-T5-T4+T3+T2-T1)*N^3$$

wherein:

k is a factor dependent on the inertia of the combustion engine,

N corresponds to an engine speed measured by the angular position of the crankshaft during the engine cycle, T1 corresponds to the instant of the initial point of the first estimator, T2 to T5 respectively corresponds to the instants of the four inflection points from the initial point to the final point of the first estimator, and T6 corresponds to the instant of the final point of the first estimator.

5. The method as claimed in claim 3, wherein the friction-resistant torque corresponds to a predetermined torque value.

6. The method as claimed in claim 4, wherein the friction-resistant torque corresponds to a predetermined torque value.

7. The method as claimed in claim 2, wherein the engine has a complete engine cycle comprising the at least one combustion phase, said evolution curve of the theoretical drive torque represents the evolution of the complete engine cycle, and the calculating the load-resistant torque is carried out for the second portion of said evolution curve of the theoretical drive torque not comprising said at least one combustion phase and comprises estimating, from a second estimator, the load-resistant torque based on the notable points of said second portion of the evolution curve of the theoretical drive torque, and determining the position of the actuator as a function of the estimated load-resistant torque and the engine rotation speed.

8. The method as claimed in claim 7, wherein the second curve portion of the theoretical drive comprises the initial point, two of the inflection points, and the final point, said second estimator depends on four of the instants and calculates the load-resistant torque from the following equation:

$$TQ_\mathrm{Load}=k*(T4-T3-T2+T1)*N^3$$

in which:

wherein:

k is a factor dependent on the inertia of the combustion engine,

N corresponds to an engine speed measured by the angular position of the crankshaft during the engine cycle, T1 corresponds to the instant of the initial point of the second estimator, T2 and T3 respectively correspond to the instants of the two inflection points from the initial point to the final point of the second estimator, and T4 corresponds to the instant of the final point of said second estimator.

9. The method as claimed in claim 2, wherein the friction-resistant torque corresponds to a predetermined torque value.

10. A method for controlling a speed of a vehicle combustion engine configured to operate at a constant speed, said vehicle combustion engine including at least one combustion chamber into which a mixture of air and fuel is injected, and an air box configured to inject the air into said at least one combustion chamber, the air box having an air flow rate controlled by a regulating butterfly valve, said regulating butterfly valve having a variable angular position controlled by a predetermined position of an actuator, said method comprising:

evaluating a load-resistant torque resulting from at least one external load applied to said engine to compensate for said load-resistant torque;

determining, from said evaluated load-resistant torque, a position of said actuator to determine an angular position of the regulating butterfly valve;

controlling the actuator in the position determined from said evaluated load-resistant torque to control said constant engine speed;

predetermining an evolution curve of a theoretical drive torque due to combustion in the combustion chamber during the engine cycle, representing an evolution of a complete engine cycle comprising at least one combustion phase, said evolution curve comprising:

a first portion including said at least one combustion phase, representative of a variation in the torque during the at least one combustion phase, to calculate a combustion drive torque, and a second portion that does not include said at least one combustion phase, representative of the load-resistant torque, to evaluate the load-resistant torque;

determining a first estimator from said evolution curve of the theoretical drive torque, corresponding to a succession of segments connected by a plurality of inflection points, each of the segments being representative of a variation in values of the theoretical drive torque during the at least one combustion phase in the at least one combustion chamber, and comprising an initial point and a final point, to calculate the combustion drive torque; and determining a second estimator from said evolution curve of the theoretical drive torque, corresponding to at least some of succession of segments connected by two of the inflection points, each of the segments corresponding to the second estimator being situated in the zero or substantially zero torque region of the evolution curve of the theoretical drive torque and comprising an initial point and a final point, to evaluate the load-resistant torque.

11. The method as claimed in claim 10, the evaluating said load-resistant torque comprises:

calculating an acceleration drive torque resulting from an acceleration of the vehicle combustion engine, determining a friction-resistant torque resulting from a plurality of frictions in the vehicle combustion engine, calculating said combustion drive torque resulting from the combustion of said mixture of air and fuel in said at least one combustion chamber, and calculating the load-resistant torque from the combustion drive torque, the acceleration drive torque, and the friction-resistant torque.

12. The method as claimed in claim 10, wherein the friction-resistant torque corresponds to a predetermined torque value.

13. The method as claimed in claim 10, wherein said vehicle combustion engine includes a crankshaft having an angular position starting from a reference position, said at least one combustion chamber having the combustion phase, the calculating the combustion drive torque comprising:

determining a first estimator from said evolution curve of said theoretical drive torque, said first estimator corresponding to a succession of segments connected to one another between an initial point and a final point and comprising a plurality of notable points, each of the segments being representative of a variation in values of the torque during the at least one combustion phase, said plurality of notable points comprising the initial point, a plurality of inflection points connecting the segments to one another, and the final point, correlating the initial point, each of the inflection points, and the final point, with the angular position of the crankshaft, measuring a plurality of instants, each of the instants corresponding to the angular position of the crankshaft, and calculating the combustion drive torque from said plurality of measured instants.

14. A method for controlling a speed of a vehicle combustion engine configured to operate at a constant speed, said vehicle combustion engine including at least one combustion chamber into which a mixture of air and fuel is injected, and an air box configured to inject the air into said at least one combustion chamber, the air box having an air flow rate controlled by a regulating butterfly valve, said regulating butterfly valve having a variable angular position controlled by a predetermined position of an actuator, said method comprising:

evaluating a load-resistant torque resulting from at least one external load applied to said engine to compensate for said load-resistant torque, the evaluating said load-resistant torque comprising:

calculating an acceleration drive torque resulting from an acceleration of the vehicle combustion engine, determining a friction-resistant torque resulting from a plurality of frictions in the vehicle combustion engine, calculating said combustion drive torque resulting from the combustion of said mixture of air and fuel in said at least one combustion chamber, and calculating the load-resistant torque from the combustion drive torque, the acceleration drive torque, and the friction-resistant torque;

determining, from said evaluated load-resistant torque, a position of said actuator to determine an angular position of the regulating butterfly valve;

controlling the actuator in the position determined from said evaluated load-resistant torque to control said constant engine speed; and predetermining an evolution curve of a theoretical drive torque due to combustion in the combustion chamber during the engine cycle, representing an evolution of a complete engine cycle comprising at least one combustion phase, said evolution curve comprising:

a first portion including said at least one combustion phase, representative of a variation in the torque during the at least one combustion phase, to calculate a combustion drive torque, and ,a second portion that does not include said at least one combustion phase, representative of the load-resistant torque, to evaluate the load-resistant torque.

15. The method as claimed in claim 14, wherein the friction-resistant torque corresponds to a predetermined torque value.

16. The method as claimed in claim 14, wherein said vehicle combustion engine includes a crankshaft having an angular position starting from a reference position, said at least one combustion chamber having the combustion phase, the calculating the combustion drive torque comprising:

determining a first estimator from said evolution curve of said theoretical drive torque, said first estimator corresponding to a succession of segments, connected to one another between an initial point and a final point, and comprising a plurality of notable points, each of the segments being representative of a variation in values of the torque during the at least one combustion phase, said plurality of notable points comprising the initial point, a plurality of inflection points connecting the segments to one another, and the final point, correlating the initial point, each of the inflection points, and the final point, with the angular position of the crankshaft, measuring a plurality of instants, each of the instants corresponding to the angular position of the crankshaft, and calculating the combustion drive torque from said plurality of measured instants.

17. A vehicle computer for a vehicle including a combustion engine configured to operate at a constant speed, said combustion engine including at least one combustion chamber into which a mixture of air and fuel is injected, and an air box configured to inject the air into said combustion chamber, the air box having an air flow rate controlled by a regulating butterfly valve, said regulating butterfly valve having a variable angular position that is controlled by a predetermined position of an actuator, wherein said computer is configured to:

evaluate a load-resistant torque resulting from a plurality of external loads applied to said engine;

determine, from said evaluated load-resistant torque, a position of said actuator to determine an angular position of the regulating butterfly valve;

control the actuator in the position determined from said evaluated load-resistant torque to regulate the constant engine speed; and predetermine a curve of a theoretical drive torque due to combustion in the combustion chamber during the engine cycle, representing an evolution of a complete engine cycle comprising at least one combustion phase, said evolution curve comprising:

a first portion including said at least one combustion phase, representative of a variation in the torque during the at least one combustion phase, to calculate a combustion drive torque, and a second portion that does not include said at least one combustion phase, representative of the load-resistant torque, to evaluate the load-resistant torque.

18. A vehicle comprising:

the vehicle computer as claimed in claim 17; and the combustion engine, having a constant engine speed.

* * * * *